US007000886B2

(12) United States Patent
Greif et al.

(10) Patent No.: US 7,000,886 B2
(45) Date of Patent: Feb. 21, 2006

(54) MOLDING FOR ARCHITECTURAL CONCRETE FORMING

(75) Inventors: Gregory M. Greif, Mission Viejo, CA (US); Ronald T Burr, Westlake Village, CA (US)

(73) Assignee: Loveday Lumber, Inc., Los Angeles, CA (US)

( * ) Notice: Subject to any disclaimer, the term of this patent is extended or adjusted under 35 U.S.C. 154(b) by 186 days.

(21) Appl. No.: 10/445,118

(22) Filed: May 23, 2003

(65) Prior Publication Data

US 2004/0232309 A1 Nov. 25, 2004

(51) Int. Cl.
*B28B 7/36* (2006.01)

(52) U.S. Cl. ..... 249/114.1; 249/134; 249/187.1

(58) Field of Classification Search ..... 249/35, 249/114.1, 134, 187.1, 189, 175; 425/468
See application file for complete search history.

(56) References Cited

U.S. PATENT DOCUMENTS

| | | | | |
|---|---|---|---|---|
| 2,296,553 | A * | 9/1942 | Heritage et al. | 264/86 |
| 4,325,899 | A * | 4/1982 | Cole et al. | 264/86 |
| 5,397,096 | A * | 3/1995 | Nelson | 249/31 |
| 5,863,369 | A | 1/1999 | Clarke et al. | |
| 6,017,640 | A | 1/2000 | Muthiah et al. | |
| 6,217,946 | B1 | 4/2001 | Bolind et al. | |
| 6,481,170 | B1 | 11/2002 | Savenok et al. | |
| 2003/0189268 | A2 * | 10/2003 | Takagi | 264/154 |

* cited by examiner

*Primary Examiner*—Donald Heckenberg
(74) *Attorney, Agent, or Firm*—Steven C. Sereboff; Joel G. Landau; SoCal IP Law Group LLP

(57) ABSTRACT

There is disclosed a molding for architectural concrete forming. The molding may be manufactured by applying a coating to a stock. The architectural molding may be rendered better-suited to certain environmental conditions or for certain uses by applying appropriate coatings.

12 Claims, 2 Drawing Sheets

MOLDING FOR ARCHITECTURAL CONCRETE FORMING

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by any one of the patent disclosure as it appears in the Patent and Trademark Office patent files or records, but otherwise reserves all copyright and trade dress rights whatsoever.

BACKGROUND OF THE INVENTION

1. Field of the Invention

The present invention relates to moldings for architectural concrete forming.

2. Description of Related Art

Many buildings are formed from concrete panels or elements. The concrete tilt-up is one example of such a structure. To make a concrete panel or element, a form is prepared and concrete is poured into the form. After the concrete sets, the form may be removed.

To enhance the aesthetic aspects of concrete panels and elements, the forms may include architectural molding. These moldings are typically made from solid wood (e.g., clear pine), and sometimes extruded plastic. Architectural molding may be manufactured on-site or prefabricated. At the job site, the architectural molding is typically cut to size when needed and added to the general form. The architectural molding is typically nailed to other parts the form.

DETAILED DESCRIPTION OF THE INVENTION

Throughout this description, the embodiments and examples shown should be considered as exemplars, rather than limitations on the apparatus and methods of the present invention.

Figure 1:
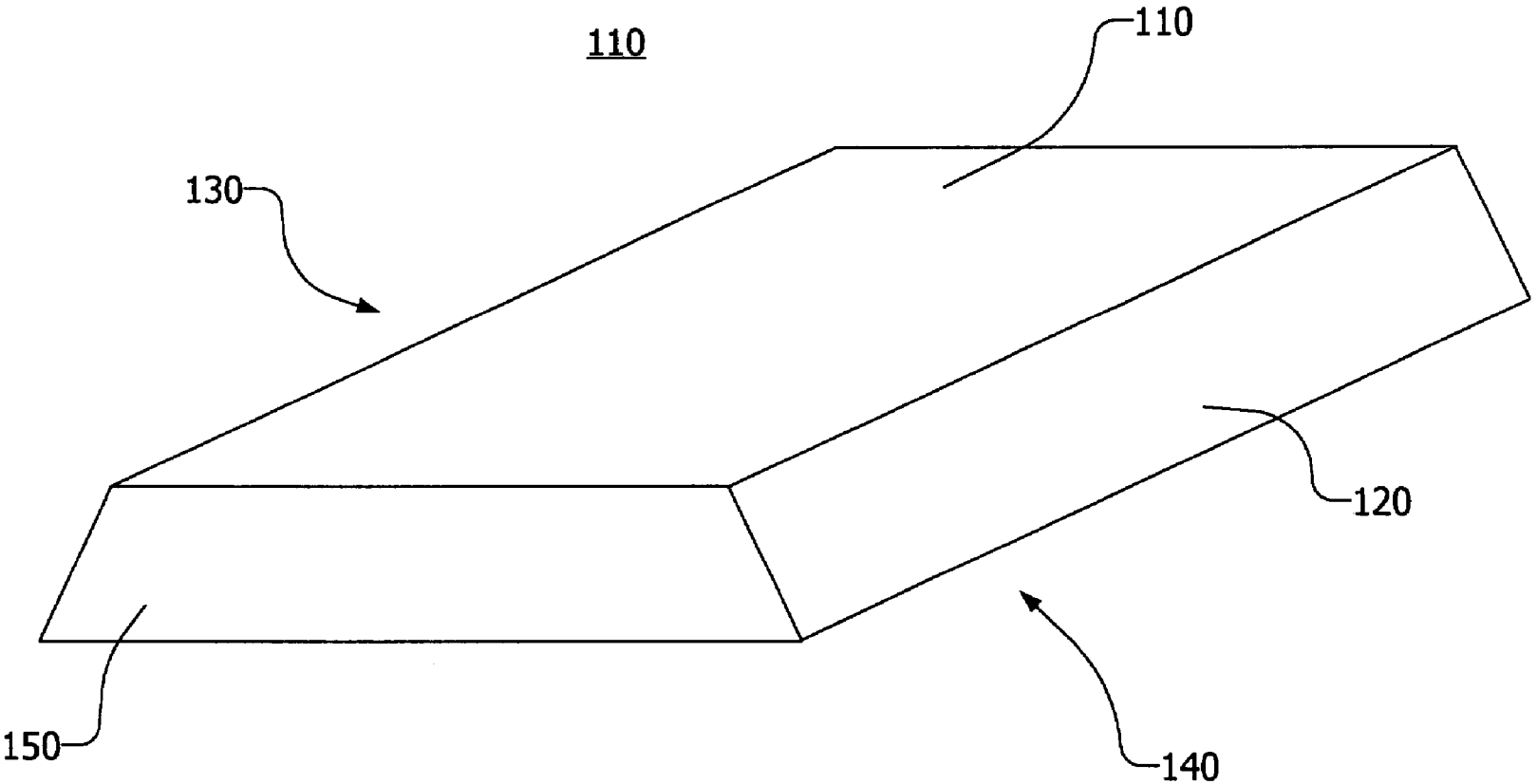
FIG. 1 is an elevated perspective view of an architectural molding in accordance with the invention.

Referring now to FIG. 1, there is shown an elevated perspective view of an architectural molding 100 in accordance with the invention. The architectural molding 100 may be a reveal, rustication, detail, chamfer or other architectural molding used in concrete forms. Architectural molding is characterized by structural strength, which allows it to withstand the pressure of uncured concrete that has been poured into a form.

Often, after the architectural molding is delivered to a job site, the architectural molding is stored in the open until used. The architectural molding is therefore exposed to the elements and may be degraded by such exposure. For example, some materials such as fiber board, have been found to warp or otherwise change shape when exposed to moisture. The moisture may be present from rain, dew, sprinklers or other environmental conditions. As explained below, the architectural molding of the invention may be manufactured to withstand such degradation.

Architectural molding may have other qualities. For example, to produce a smooth concrete surface, the architectural molding have a smooth surface which faces the concrete. If a textured concrete surface is desired, it may be obtained from architectural molding having a corresponding textured surface which faces the concrete.

As used herein, "concrete" means a pourable substance which sets into a hard, strong building material. Concrete may be made by mixing a cementing material (such as portland cement) and a mineral aggregate (such as sand and gravel) with sufficient water to cause the cement to set and bind the entire mass.

The architectural molding 100 comprises a stock to which a coating has been applied. The stock may have one or more surfaces 110, 120, 130 which will, when the architectural molding 100 is used, will face the poured concrete. These surfaces 110, 120, 130 will be referred to herein as "exposed" surfaces. In addition to the exposed surfaces 110, 120, 130, the stock 110 may define one or more unexposed surfaces 140, 160. There may also be partially exposed surfaces. Altogether, the exposed, unexposed and partially exposed surfaces make up an entire outside surface of the architectural molding.

The stock may comprise a material such as medium density fiber board (MDF). MDF and many other materials are porous and water absorptive. These materials are sponge-like, and will absorb water which impinges on their surface. Depending on their manufacture and inherent properties, these materials have an entire exposed surface, a substantial portion of the exposed surface, or a small portion of the exposed surface which is porous.

The stock may also comprise solid wood, wood fibers, particle board, extruded plastics, metals, composites and other materials which are hard and strong enough for use in concrete forms. The stock may comprise a single material or a combination of materials, and the combinations may be homogenous or not. The stock may include a binder for binding constituents.

The stock may have a predefined shape or cross-section adapted and especially suited for use in architectural molding. For example, chamfer generally has a triangular cross-section.

The architectural molding 100 may include a coating which substantially evenly covers the exposed surface of the stock. The coating may overcome the water absorptive and/or porous qualities of the stock. The coating may be water proof or water resistant. The coating may include or be a coloring agent. As used herein, "coloring agent" refers to a pigment, dye, paint or other substance which will give the stock a color different from its appearance without the coloring agent. The coloring agent may be visible upon application or may rendered visible by drying or some other process. The coating may include wax, oil, plastics, and/or resins. Color may be useful for making the architectural molding 100 easily identifiable as to its source, quality, type or otherwise. Since architectural molding is generally not visible when installed in a concrete form, and the concrete form is temporary, color may have no aesthetic benefits.

The coating may comprise one or more layers. Extra layers may be desired or necessary to achieve evenness, or so that separate materials may be applied, such as a water proofer in one layer and a coloring agent in a second layer.

The coating may maintain or alter the surface quality of the stock. For example, an otherwise smooth exposed surface may be coated to have a texture. The texture may be even, grained or patterned, for example. Alternatively, the exposed surface of a stock may be coated to be smooth—even smoother than the stock itself. Other qualities may include slippery or waxy.

The coated architectural molding 100 may be used as part of a concrete form.

Figure 2:
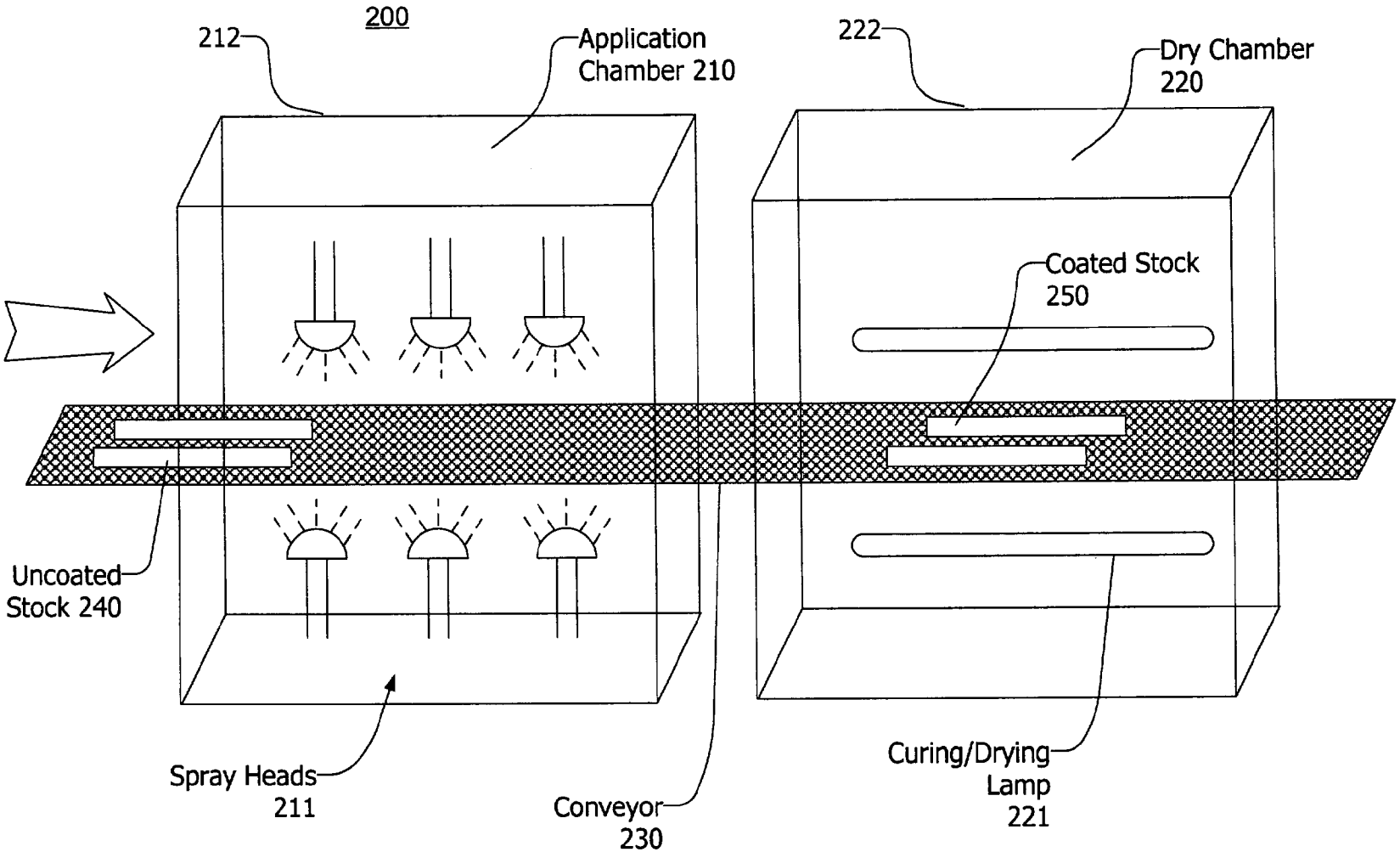
FIG. 2 is an apparatus for manufacturing an architectural molding for concrete forming in accordance with the invention.

Referring now to FIG. 2 there is shown an apparatus 200 for manufacturing an architectural molding for concrete forming in accordance with the invention. The apparatus comprises an application chamber 210, a dry chamber 220 and a conveyor 230. The apparatus will be described in conjunction with a method of manufacturing an architectural molding for concrete forming in accordance with the invention.

The method begins with stock 240. As a preliminary step, the stock may be shaped to be suitable as, for example, chamfer or reveal. This shaping may through cutting, molding or other techniques.

In one step, stock 240 is moved on the conveyor 230 into the application chamber 210. The conveyor 230 may be, for example, a belt, web or mesh. The conveyor 230 may be a continuous loop. Alternatively, the conveyor 230 may comprise a series of rollers across which the stock 240 slides, and the conveyor 230 may include an apparatus for pushing the stock 240 along the rollers.

In another step, in the application chamber 210, a coating is mechanically applied to the stock 240. The application chamber 210 may include one or more spray heads 211 for applying the coating housed within an enclosure 212. The spray heads 211 may be located above and below the conveyor to provide single-pass coverage, and the spray heads may move to provide coverage. The coating may be applied through other methods, such as dipping, or passing the stock 240 through a stream. The coating may be applied as a liquid, a solid, a slurry, a colloid, a vapor, a gas or other form. The coating may be prepared on-site, such as by mixing a water sealant with a coloring agent.

Through mechanical application, a substantially even application of the coating may be obtained. It has been found that manual application provides unsatisfactory results because of missed spots or over-application. In addition, some coating materials do not lend themselves to manual application due to their hazardous nature. Because of the controls afforded through mechanical application, the coating may be applied to just the exposed surface of the stock, or to the entire outside surface of the stock.

After the application step, the now-coated stock 250 may be moved out of the application chamber 210 and into a dry chamber 220. The dry chamber 220 may include one or more curing or drying lamps 221 housed within an enclosure 222. Within the dry chamber 220, the coating may cure, set, dry or otherwise change. The form change may be made possible or controlled by use of light, heat, radiation, catalysts, pressure, etc. For example, a water sealant may set, or a coloring agent may be rendered visible. The coated stock 250 may then be moved out of the drying changer as finished architectural molding.

The architectural molding of the invention may have a wide range of environmental usability, or may be tailored to perform well in certain environmental conditions. For example, the coating may be suitable for temperatures between 0 and 115° F.

The entire process of manufacturing an architectural molding for concrete forming may be automated. Alternatively, selected steps may be automated. For example, the steps of moving the stock into the application chamber 210, applying the coating and moving the stock out of the application chamber 210 may be fully automatic.

Although shown as separate chambers, the application chamber 210 and dry chamber 220 may be contiguous or continuous. Where several layers are to be applied, for example, there may be several application chambers and several dry chambers, and the type of chambers may alternate. In addition, the application chamber 210 and the dry chamber 220 may include or omit the enclosures 212, 222.

Although exemplary embodiments of the present invention have been shown and described, it will be apparent to those having ordinary skill in the art that a number of changes, modifications, or alterations to the invention as described herein may be made, none of which depart from the spirit of the present invention. All such changes, modifications and alterations should therefore be seen as within the scope of the present invention.

It is claimed:

1. An apparatus for architectural concrete forming for use in forming a concrete panel or element, the molding for architectural concrete forming comprising a concrete form a stock comprising a water absorptive material, the stock defining an exposed surface and an unexposed surface, the exposed surface adapted for facing poured concrete, the unexposed surface attached to the concrete form, wherein at least a substantial portion of the exposed surface is porous a waterproof or water resistant coating substantially evenly covering the exposed surface of the stock.

2. The apparatus for architectural concrete forming of claim 1 wherein the stock comprises fiber board.

3. The apparatus for architectural concrete forming of claim 1 wherein the stock comprises primarily wood fibers.

4. The apparatus for architectural concrete forming of claim 3 wherein the stock further includes a binder for binding the wood fibers.

5. The apparatus for architectural concrete forming of claim 1 wherein the stock comprises a chamfer.

6. The apparatus for architectural concrete forming of claim 1 wherein the stock comprises a reveal, a detail or a rustication.

7. The apparatus for architectural concrete forming of claim 1 wherein the stock defines an entire outside surface which includes the exposed surface, and the coating substantially evenly covers the entire outside surface of the stock.

8. The apparatus for architectural concrete forming of claim 1 wherein the coating is water proof.

9. The apparatus for architectural concrete forming of claim 1 wherein the coating is water resistant.

10. A molding for architectural concrete forming for use in fabricating a concrete form, for subsequent use in forming a concrete panel or element, the molding for architectural concrete forming comprising:

a stock comprising a water absorptive material, the stock defining an exposed surface and an unexposed surface, the exposed surface adapted for facing poured concrete, the exposed surface adapted for attaching to the concrete form, wherein at least a substantial portion of the exposed surface is porous a waterproof or water resistant coating substantially evenly covering the exposed surface of the stock wherein the coating comprises a coloring agent.

11. The apparatus for architectural concrete forming of claim 1 wherein the coating is applied to the stock by moving the stock on a conveyor into an application chamber mechanically spraying the stock moving the sprayed stock out of the application chamber.

12. The apparatus for architectural concrete forming of claim 11 wherein the coating is applied to the stock further by moving the stock into a dry chamber drying the stock in the dry chamber moving tho dried stock out of the drying changer.

* * * * *

UNITED STATES PATENT AND TRADEMARK OFFICE

CERTIFICATE OF CORRECTION

PATENT NO. : 7,000,886 B2
APPLICATION NO. : 10/445118
DATED : February 21, 2006
INVENTOR(S) : Gregory M. Greif et al.

It is certified that error appears in the above-identified patent and that said Letters Patent is hereby corrected as shown below:

Column 1,
Line 34, replace “parts the form” with -- parts of the form --.

Column 4,
Line 65, replace “tho” with -- the --.

Signed and Sealed this

Fourth Day of July, 2006

JON W. DUDAS
*Director of the United States Patent and Trademark Office*